US009627098B2

(12) United States Patent
Ganguly

(10) Patent No.: US 9,627,098 B2
(45) Date of Patent: Apr. 18, 2017

(54) REAL-TIME MOVING COLLIMATORS MADE WITH X-RAY FILTERING MATERIAL

(71) Applicant: Varian Medical Systems, Inc., Palo Alto, CA (US)

(72) Inventor: Arundhuti Ganguly, San Jose, CA (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 75 days.

(21) Appl. No.: 14/037,763

(22) Filed: Sep. 26, 2013

(65) Prior Publication Data

US 2014/0270069 A1 Sep. 18, 2014

Related U.S. Application Data

(60) Provisional application No. 61/785,223, filed on Mar. 14, 2013.

(51) Int. Cl.
*G21K 1/04* (2006.01)

(52) U.S. Cl.
CPC ..... *G21K 1/046* (2013.01); *G21K 1/04* (2013.01)

(58) Field of Classification Search
CPC .... A61N 5/1042; A61N 5/1067; A61N 5/107; A61N 5/1048; A61N 5/1045; A61N 5/1064; A61N 5/1031; A61N 5/1036; A61N 5/1047; A61N 5/1077; A61N 5/1065; A61N 2005/1094; G21K 1/046; G21K 1/04; G21K 1/10; G21K 1/02; G21K 1/025; G21K 1/043
See application file for complete search history.

(56) References Cited

U.S. PATENT DOCUMENTS

| | | | | |
|---|---|---|---|---|
| 4,355,331 | A * | 10/1982 | Georges et al. | 378/98.11 |
| 4,426,721 | A * | 1/1984 | Wang | 250/370.09 |
| 5,008,907 | A * | 4/1991 | Norman et al. | 378/65 |
| 5,332,908 | A * | 7/1994 | Weidlich | 250/492.1 |
| 5,748,703 | A * | 5/1998 | Cosman | 378/152 |
| 6,266,393 | B1 * | 7/2001 | Ein-Gal | 378/152 |
| 6,330,300 | B1 * | 12/2001 | Siochi | 378/65 |
| 6,730,924 | B1 * | 5/2004 | Pastyr et al. | 250/505.1 |

(Continued)

FOREIGN PATENT DOCUMENTS

FR 2676584 A1 * 11/1992 ..... G21K 1/10

OTHER PUBLICATIONS

Rudin et al., Real-time equalization of region-of-interest fluoroscopic images using binary masks, Med. Phys. 26 *7), (1999), 1359-1364.

*Primary Examiner* — Michael Logie
(74) *Attorney, Agent, or Firm* — Houst Consulting

(57) ABSTRACT

An apparatus includes an x-ray source operable to generate x-ray beams, a collimator comprising one or more leaves configured to modify the x-ray beams, a motorized system operable to move the one or more leaves of the collimator independently in or out of the x-ray beams, and a controller configured to synchronize operation of the x-ray source and the motorized system, allowing modification of the x-ray beams substantially in real time with generation of the x-ray beams. At least one leaf or each of the leaves of the collimator may be configured to modulate a beam quality of the x-ray beams.

24 Claims, 4 Drawing Sheets

(56) References Cited

U.S. PATENT DOCUMENTS 7,085,355 B1* 8/2006 Albagli ..... G21K 1/02 378/147
7,680,249 B2* 3/2010 Yuan ..... A61B 6/00 378/156
7,983,391 B2 7/2011 Machan et al.
2002/0101959 A1* 8/2002 Kato et al. ..... 378/152
2003/0081721 A1* 5/2003 Siochi ..... 378/65
2003/0138078 A1* 7/2003 Eberhard et al. ..... 378/145
2004/0105525 A1* 6/2004 Short et al. ..... 378/98.8
2004/0264647 A1* 12/2004 Graf ..... G21K 1/10 378/157
2005/0058245 A1* 3/2005 Ein-Gal ..... 378/65
2006/0023842 A1* 2/2006 Sohal ..... G21K 1/04 378/147
2006/0050746 A1* 3/2006 Elyan et al. ..... 372/10
2006/0067481 A1* 3/2006 Morton ..... A61B 6/06 378/151
2007/0081628 A1* 4/2007 Dasani ..... G01N 23/04 378/62
2007/0201613 A1* 8/2007 Lu et al. ..... 378/65
2008/0144772 A1* 6/2008 Yi et al. ..... 378/65
2008/0159478 A1* 7/2008 Keall et al. ..... 378/65
2008/0198963 A1 8/2008 Spahn et al.
2008/0232548 A1* 9/2008 Tanaka ..... A61B 6/504 378/98.2
2008/0267356 A1* 10/2008 Johnsen ..... 378/152
2008/0279337 A1* 11/2008 Yuan ..... A61B 6/00 378/156
2009/0022267 A1* 1/2009 Kondo ..... 378/15
2010/0034357 A1* 2/2010 Svesson et al. ..... 378/152
2010/0119033 A1* 5/2010 Li et al. ..... 378/5
2010/0189220 A1* 7/2010 Flynn ..... A61N 5/103 378/65
2010/0246775 A1* 9/2010 Yuan ..... G21K 1/10 378/158
2010/0260319 A1* 10/2010 Ein-Gal ..... 378/65
2011/0013742 A1* 1/2011 Zaiki ..... A61B 6/035 378/15
2011/0075805 A1 3/2011 Machan et al.
2011/0200170 A1* 8/2011 Nord et al. ..... 378/65
2012/0043481 A1* 2/2012 Mansfield et al. ..... 250/492.1
2012/0128120 A1* 5/2012 De Man ..... A61B 6/032 378/16
2012/0183197 A1* 7/2012 Gleich ..... 382/132
2012/0215095 A1* 8/2012 Av-Shalom ..... A61B 6/06 600/424
2013/0023718 A1* 1/2013 Nord et al. ..... 600/1
2013/0034211 A1* 2/2013 Claesson ..... 378/65
2014/0094643 A1* 4/2014 Gall ..... H05H 13/02 600/2
2014/0169525 A1* 6/2014 Shimizu et al. ..... 378/62
2014/0177782 A1* 6/2014 Herold ..... 378/4
2014/0226794 A1* 8/2014 Quam et al. ..... 378/150
2014/0239204 A1* 8/2014 Orton et al. ..... 250/505.1
2015/0245804 A1* 9/2015 Kieft ..... A61B 6/06 378/147

* cited by examiner

REAL-TIME MOVING COLLIMATORS MADE WITH X-RAY FILTERING MATERIAL

TECHNICAL FIELD

Embodiments of this disclosure relate to radiation devices and methods. In particular, real-time moving collimators and imaging methods using the collimators are described.

BACKGROUND

Conventional x-ray collimators are typically constructed for shaping x-ray beams. Usually, conventional collimators include beam blocking leaves made of x-ray attenuating materials that have high atomic number (high-Z material). In most cases, the collimator beam blocking leaves cut out portions of the beam that are not useful for diagnostic, guidance, or therapy purposes. The collimator leaves are either manually moved or motorized with some systems allowing control over the motion of individual leaves for shrinking or expanding the x-ray field of view. However, conventional collimators have not been designed to modulate the beam quality of an x-ray beam such as the beam energy, intensity, or dose distribution.

Accordingly, there is a need for a collimator device that can be used to modify the beam quality and the shape and size of a beam. There is a need for a radiation apparatus in which the operation of the x-ray source and the collimator device can be synchronized such that the modification of the beam quality, shape, or size of a beam can be substantially in real time with the generation of the beam.

SUMMARY

Various embodiments of an x-ray collimator and a method for collimating x-rays using the collimator are described. The collimator may comprise an individual leaf or leaves that can be motorized such that each leaf can be moved independently in and out of the x-ray beam. The individual leaf or leaves can be all completely attenuating or all partially attenuating of x-rays. Alternatively, the individual leaves can be a combination of partially and completely attenuating of x-rays. The leaf or leaves can be allowed to cover the entire or partial field of view of the x-rays. The movement of the individual leaf or leaves can be synchronized with the operation of the x-ray source to modify the beam on a per pulse basis. The disclosed collimator allows rapidly changing of the beam quality of x-rays from pulse to pulse, and hence the images acquired using the x-rays.

A method of multi-energy imaging is described. An imaging method using x-rays of different beam qualities for a region of interest in a body portion and for the rest of the body portion is also described. Other embodiments of the disclosure are further described in the Detail Description.

This Summary is provided to introduce selected embodiments in a simplified form and is not intended to identify key features or essential characteristics of the claimed subject matter, nor is it intended to be used as an aid in determining the scope of the claimed subject matter.

BRIEF DESCRIPTION OF THE DRAWINGS

These and other features and advantages of the disclosed methods and apparatuses will become better understood upon reading of the following detailed description in conjunction with the accompanying drawings and the appended claims provided below, where:

DETAILED DESCRIPTION

Figure 1:
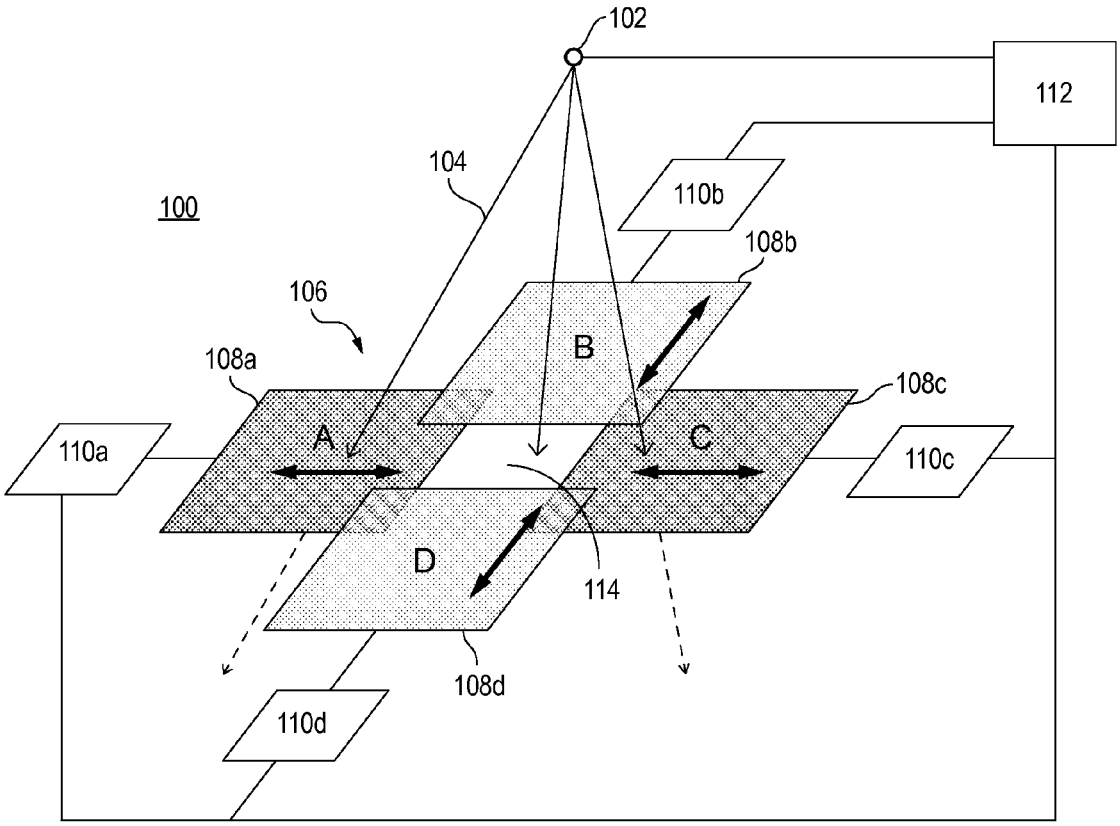
FIG. 1 is a schematic representation of an exemplary collimator assembly according to some embodiments of this disclosure.

Various embodiments of an x-ray collimator, an apparatus including the x-ray collimator, and an imaging method using the x-ray collimator are described. It is to be understood that the disclosure is not limited to the particular embodiments described as such may, of course, vary. An aspect described in conjunction with a particular embodiment is not necessarily limited to that embodiment and can be practiced in any other embodiments. Further, in the following description, specific details such as examples of specific materials, dimensions, processes, etc. may be set forth in order to provide a thorough understanding of the disclosure. It will be apparent, however, to one of ordinary skill in the art that these specific details need not be employed to practice embodiments of the disclosure. In other instances, well known components or process steps may not be described in detail in order to avoid unnecessarily obscuring the embodiments of the disclosure.

As used in the description and appended claims, the singular forms of "a," "an," and "the" may include plural references unless the context clearly dictates otherwise.

As used herein, the term "collimator" refers to a device that can modify one or more parameters of an x-ray beam such as the energy, intensity, shape, size, direction, dose distribution, or other beam parameters. A collimator may include one or more leaves configured to modify one or more parameters of an x-ray beam. A collimator leaf may be partially x-ray attenuating or completely x-ray attenuating.

As used herein, the term "completely x-ray attenuating" refers to complete or substantially complete block of x-rays by a collimator leaf such that the amount of x-rays passing through the collimator leaf is negligible or is not intended for any useful imaging or treatment. A collimator leaf that is completely x-ray attenuating may be referred to as a beam blocking leaf in this disclosure.

As used herein, the term "partially x-ray attenuating" refers to that a portion of x-rays passes through a collimator leaf and contributes to imaging or treatment. A collimator leaf that is partially x-ray attenuating may be referred to as a beam filter in this disclosure.

As used herein, the term "beam quality" refers to the energy, intensity, or dose distribution of an x-ray beam.

An apparatus is provided in this disclosure. The apparatus may include an x-ray source operable to generate x-ray beams, a collimator having one or more leaves configured to modify the x-ray beams, a motorized system operable to move the one or more leaves of the collimator independently in or out of the x-ray beams, and a controller configured to synchronize operation of the x-ray source and the motorized system, allowing modification of the x-ray beams substantially in real time with generation of the x-ray beams. At least one leaf or each of the leaves of the collimator may be configured to modulate a beam quality of the x-ray beams.

The x-ray source may generate x-ray beams in pulses and the motorized system may be operable to move the one or more leaves in synchrony with the operation of the x-ray source, thus allowing modification of the x-ray beams on a pulse to pulse basis.

A collimator assembly is provided in this disclosure. The collimator assembly may include two or more leaves configured to modify an x-ray beam and a motorized system operable to move the two or leaves independently in or out of the x-ray beam. The two or more leaves may be configured to modify the size or shape of the x-ray beam or to modulate a beam quality of the x-ray beam. In some embodiments, at least one of the two or more leaves may be configured to modulate a beam quality of the x-ray beam. In some embodiments, each of the two or more leaves may be configured to modulate the beam quality of the x-ray beam. Each of the two or more leaves can be partially x-ray attenuating or completely x-ray attenuating. Alternatively, the two or more leaves comprise a combination of partially and completely x-ray attenuating leaves.

In some embodiments, the two or more leaves can be positioned to define an aperture to allow a first portion of the x-ray beam passing through the aperture and a second portion of the x-ray beam passing through the thickness of the leaves, thereby providing a modified beam having a first beam portion that passes through the aperture and a second beam portion that passes through the thickness of the leaves. The first beam portion has a first beam quality and the second beam portion has a second beam quality. Each of the two or more leaves can be moved independently to cover an entire field of view of the x-ray beam. Therefore, the aperture defined by the two or more leaves can be located in anywhere within the field of view.

In a non-limiting specific embodiment, a collimator assembly comprises four leaves each can be independently moved in or out of the x-ray beam. The four leaves can be set up in a configuration such that the adjacent two leaves can be linearly moved in directions substantially perpendicularly to each other. Each of the four leaves can be allowed to cover an entire field of view of the x-ray beam. Each of the four leaves can be made of a different partially x-ray attenuating material. Alternatively, each of the four leaves can be made of a same partially x-ray attenuating material of different thicknesses such that each leaf can modulate a beam quality of x-ray beams differently for different applications. Alternatively, each of the four leaves can be made of a same partially x-ray attenuating material or a material of a same attenuating property such that the collimator can provide a modified beam having beam portions of different beam qualities, e.g., a first beam portion passing through an aperture defined by the leaves and a second beam portion passing through the thicknesses of the leaves. Alternatively, each of the four leaves can be made of a same or different completely x-rays attenuating material such that the leaves can rapidly shape or size the x-ray beam by rapidly changing the aperture defined by the leaves and blocking the beams outside the aperture.

An imaging method is provided in this disclosure. The imaging method comprises the step of directing an x-ray beam to a body portion containing a region of interest. The x-ray beam has a first beam portion directed to the region of interest and a second beam portion directed to the rest of the body portion, wherein the first beam portion has a first beam quality and the second beam portion has a second beam quality different from the first beam quality. An image is acquired including both the region of interest and the rest of the body portion.

The x-ray beam having a first and a second beam portions can be provided by a collimator assembly comprising two or more leaves, wherein each of the two or more leaves comprises a same material that partially attenuates x-rays or a material of same x-ray attenuating property. The two or more leaves can be independently moved by a motorized system to define an aperture, thereby allowing the first beam portion passing through the aperture to the region of interest and the second beam portion passing through the thicknesses of the two or more leaves to the rest of the body portion. The two or more leaves of the collimator assembly can be moved in synchrony with the operation of the x-ray source such that the aperture can be defined substantially in real time with generation of the x-rays.

In a non-limiting specific embodiment, the x-ray beam having a first and a second beam portions can be provided by a collimator comprising four leaves. Each of the four leaves may comprise a same material that partially attenuates x-rays or a material of same x-ray attenuating property. The four leaves can be set up in a configuration that adjacent two leaves are linearly movably in directions substantially perpendicularly to each other. The leaves can be independently moved to define an aperture, thereby allowing the first beam portion passing through the aperture to the region of interest and the second beam portion passing through the thicknesses of the leaves to the rest of the body portion. The four leaves of the collimator can be moved in synchrony with the operation the x-ray source such that the aperture can be defined substantially in real time with generation of the x-rays.

A multi-energy imaging method is provided in this disclosure. In the method, a first image of a body portion may be acquired using a first pulse of x-rays having a first energy and a second image of the body portion may be acquired using a second pulse of x-rays having a second energy. The first and second images are combined to provide a third image. The first and second pulses of x-rays may be generated by an x-ray source and modulated by a collimator assembly. The collimator assembly may comprise two or more leaves each being independently moveable in synchrony with the operation of the x-ray source such that the beam quality of the first or second pulse of x-rays can be modulated by one of the two or more leaves substantially in real time with generation of the first or second pulses. In some embodiments, the beam quality of each of the first and second pulses of x-rays can be modulated by one of the two or more leaves substantially in real time with generation of the each of the first and second pulses.

Exemplary embodiments will now be described with reference to the figures. It should be noted that some figures are not necessarily drawn to scale. The figures are only intended to facilitate the description of specific embodiments, and are not intended as an exhaustive description or as a limitation on the scope of the disclosure.

FIG. 1 schematically shows an exemplary radiation apparatus 100 according to some embodiments of the disclosure. The radiation apparatus 100 may include a radiation source 102 operable to generate an x-ray beam 104 and a collimator 106 configured to modify the x-ray beam 104. The collimator 106 may include one or more leaves 108*a*, 108*b*, 108*c*,

108*d* each of which can be moved in and out of the x-ray beam 104, as indicated by the arrows. A motorized system 110 may include one or motion mechanisms 110*a*, 110*b*, 110*c*, 110*d* each of which may be coupled to one of the leaves 108*a*, 108*b*, 108*c*, 108*d* to independently move the leaves in and out of the x-ray beam 104. A controller 112 may be coupled to the x-ray source 102 and the motorized system 110 to synchronize the operation of the x-ray source 102 and the motorized system 110 such that the modification of the beam is substantially in real time with the generation of the x-rays.

The x-ray source 102 may be an x-ray tube or accelerator supported by an arm structure which may be movable in various degrees of freedom. The x-ray source 102 may be configured to generate x-rays at any suitable energy levels such as kilovolt (keV) energy levels and/or megavolt (MV) energy levels. The x-ray source 102 may include a signal beam generator which is capable of generating x-rays at multiple energy levels. The x-ray source 102 may also include two or more generators, e.g. one for generating radiations at a keV level and one for generating radiations at an MV level. In general, an x-ray source includes a target which is configured to produce x-rays upon impingement by energetic electrons. Generation of x-rays is known in the art and its detail description is omitted herein for clarity of description of this disclosure. In some embodiments, provided is a collimator device that may be particularly useful in conjunction with an x-ray source that is configured to produce x-rays at keV energy levels for imaging. The x-ray source such as an x-ray tube may generate x-rays on a pulse by pulse basis. It will be appreciated however that the provided collimator assembly can be used in conjunction with any kind of x-ray sources.

The collimator leaves 108*a*, 108*b*, 108*c*, 108*d* may be configured to modulate the beam quality of the x-ray beam 104. For example, each of the leaves 108*a*, 108*b*, 108*c*, 108*d* may be made of a partially x-ray attenuating material to modify the beam quality. The partially x-ray attenuating material can be selected such that the beam intensity or beam mean energy can be changed after the x-rays pass through the leaves. Each of the leaves 108*a*, 108*b*, 108*c*, 108*d* may be made of a same partially x-ray attenuating material. Alternatively, each of the leaves 108*a*, 108*b*, 108*c*, 108*d* may be made of a different partially x-ray attenuating material so that the beam quality can be modified differently using different leaves depending on application requirements. In some embodiments, each of the leaves 108*a*, 108*b*, 108*c*, 108*d* can be made of a same partially attenuating material but with a different thickness to modify the beam quality differently. In some embodiments, each of the leaves 108*a*, 108*b*, 108*c*, 108*d* can be made of a different partially attenuating material with a different thickness.

Partially x-ray attenuating materials are typically medium to low-Z (atomic number) materials. High-Z materials with a small thickness can also be used as partially attenuating materials. By way of example, beryllium may be at the low end of Z and lead may be at the high end of Z which can be used as partially x-ray attenuating materials. Any element, an alloy or compound having a Z number between beryllium and lead can be used as partially x-ray attenuating materials.

Figure 2:
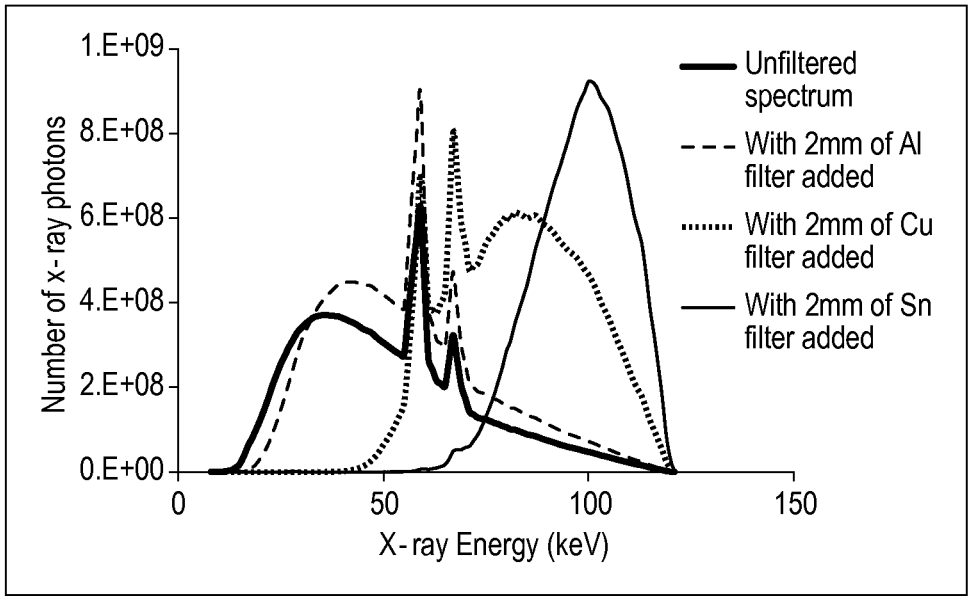
FIG. 2 illustrates an unfiltered x-ray spectrum and x-ray spectra after being filtered by some different filtering materials.

An x-ray beam emitted from an x-ray source typically has a continuous range of energies (spectrum) up to a maximal value. The maximal value depends on the peak voltage applied to the x-ray source. A partially x-ray attenuating material may have a unique attenuation spectrum or ability to stop x-ray photons at each energy level over the range of x-ray energies. Therefore, depending on the x-ray attenuating material used for the leaves, the x-ray beams emitted from an x-ray source can be modified. The resultant beam may have an average energy that is different from the original spectrum of energies. In some cases the partially attenuating material may selectively remove low energy x-rays resulting in a high average energy spectrum, while in other cases the mean energy may not be reduced significantly but the beam intensity may be reduced depending on the application requirement. FIG. 2 shows a typical x-ray spectrum generated by an x-ray source and the effect of filtration by different x-ray attenuating materials. As shown, depending on the x-ray attenuating material, the energy distribution and hence the mean energy and intensity of the spectrum changes. In FIG. 2, a same thickness (2 mm) of aluminum, copper and tin changes the beam spectrum, from the original unfiltered beam mean energy of 51.52 keV to mean energies of 55.86 keV, 82.21 keV and 97.94 keV, respectively.

Figure 3:
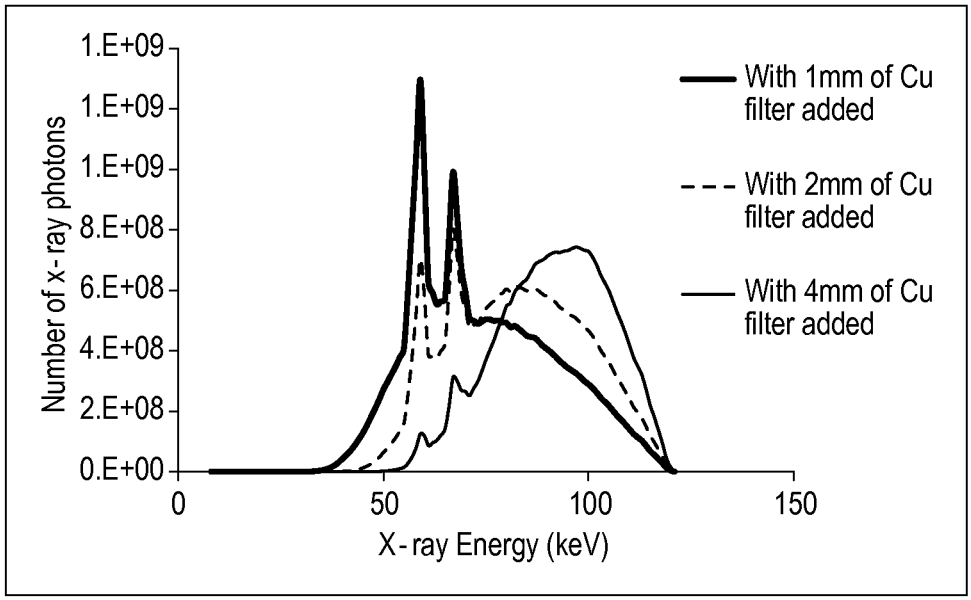
FIG. 3 illustrates an effect of thicknesses of a filtering material on an x-ray spectrum.

The thicknesses of the partially x-ray attenuating material may further define the intensity and distribution of energies of the beam. FIG. 3 shows that different thicknesses (1, 2, and 4 mm) of the same material copper modify the beam differently. Therefore, leaves made of a same partially x-ray attenuating material with different thicknesses may modulate the beam quality differently. In general, the thickness of a partially x-ray attenuating material required for a same or similar change in intensity is smaller for higher Z than for low Z material. The effect of the material and its thickness on the final spectrum is given by Beer's Law:

$$I(E)=I0\exp[-\mu(E)*x]$$

where I is the beam intensity at any energy E after attenuating the original intensity I0. The attenuation coefficient for the given energy is constant for the material and determines how much of the beam is stopped in the material of thickness x.

Returning to FIG. 1, the collimator 106 may also be configured to modify the shape and/or size of the x-ray beam 104. The leaves 108*a*, 108*b*, 108*c*, 108*d* can be made of a completely x-ray attenuating material that has a high-Z or atomic number. The leaves 108*a*, 108*b*, 108*c*, 108*d* can form an aperture 114 defining a shape and/or size to allow a portion of the beam passing through and block the rest of the beam outside of the aperture 114, as will be described in greater detail below.

The motorized system 110 may include one or more motion mechanisms 110*a*, 110*b*, 110*c*, 110*d* each of which may be coupled to one of the leaves 108*a*, 108*b*, 108*c*, 108*d* to independently drive the leaf in and out of the x-ray beam 104. Each of the motion mechanisms 110*a*, 110*b*, 110*c*, 110*d* may include a motor. By way of example, a motion mechanism may preferably include a servo motor and one or more feedback devices that are electrically coupled to the controller 112 operable with user interface software. A close loop control can be used to control the motion mechanisms and automatically adjust the position of the leaves in the beam. The motion mechanisms 110*a*, 110*b*, 110*c*, 110*d* may move the leaves 108*a*, 108*b*, 108*c*, 108*d* in linear directions. Alternatively, the motion mechanisms 110*a*, 110*b*, 110*c*, 110*d* may move the leaves 108*a*, 108*b*, 108*c*, 108*d* in angular directions.

Figure 4A:
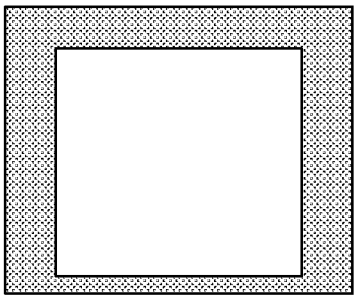
FIG. 4A illustrates an image frame having two regions acquired using an x-ray beam having beam portions of different beam qualities.

As shown in FIG. 1, the motion mechanisms 110*a*, 110*b*, 110*c*, 110*d* may independently move the leaves 108*a*, 108*b*, 108*c*, 108*d* in the x-ray beam 104 such that the positions of the leaves 108*a*, 108*b*, 108*c*, 108*d* in the beam 104 may define an aperture 114. As such, a portion of the x-ray beam 104 may pass through the aperture 114, providing a beam portion having a shape and size defined by the aperture 114. Outside the aperture 114, the x-rays would be either blocked or modulated depending on the attenuating properties of the leaves 108*a*, 108*b*, 108*c*, 108*d*. In embodiments where the leaves 108*a*, 108*b*, 108*c*, 108*d* are partially x-ray attenuating, the portion of x-rays outside the aperture 114 may pass through the thicknesses of the leaves 108*a*, 108*b*, 108*c*, 108*d*, providing a beam portion having a beam quality that is different from that of the beam portion passing through the aperture 114. FIG. 4A schematically shows a single image frame having two regions formed by a beam having two beam portions each beam portion having a different beam quality that can be provided by the collimator 106 described above. In embodiments where the leaves 108*a*, 108*b*, 108*c*, 108*d* are completely x-ray attenuating, the portion of x-rays outside the aperture 114 is blocked.

Figure 4B:
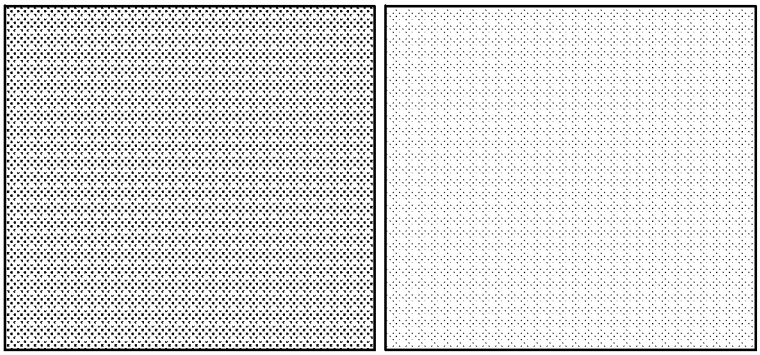
FIG. 4B illustrates two successive image frames acquired using two different x-ray beams of different but uniform beam qualities.

Returning to FIG. 1, in some embodiments, one motion mechanism e.g. 110*a* may extend one leaf e.g. 108*a* in the x-ray beam 104 to cover the entire field of view, and the other motion mechanisms 110*b*, 110*c*, 110*d* may retract the rest of the leaves 108*b*, 108*c*, 108*d* out of the beam 104. As such, the x-ray beam 104 may be modulated by a single leaf 108*a* covering the entire field of view. Similarly, the motion mechanism 110*b* may extend a different leaf e.g. leaf 108*b* in the x-ray beam 104 to cover the entire field of view, and the other motion mechanisms 110*a*, 110*c*, 110*d* retract the rest of the leaves 108*a*, 108*c*, 108*d* out of the beam so that the x-ray beam 104 may be attenuated by the single leaf 108*b* having a attenuating property different from that of leaf 108*a*. Motion mechanisms 110*c* or 110*d* may similarly extend a single leaf 108*c* or 108*d*, which may have an attenuating property different from those of other leaves, in the beam 104 and modulate the beam 104 using the single leaf 108*c* or 108*d* to provide a modulated beam having a different beam quality. FIG. 4B schematically shows two successive image frames formed by two x-ray beams where the beam quality is uniform for each image frame but differs from frame to frame.

Returning to FIG. 1, the controller 112 may be coupled to the x-ray source 102 and the motion mechanisms 110*a*, 110*b*, 110*c*, 110*d*. The controller 112 may be configured or programmed to activate and control the x-ray source 102 and the motion mechanisms 110*a*, 110*b*, 110*c*, 110*d*. The controller 112 may synchronize the operation of the x-ray source 102 and the motion mechanisms 110*a*, 110*b*, 110*c*, 110*d* such that the movement of the leaves 108*a*, 108*b*, 108*c*, 108*d* in and out of the x-ray beam 104 may be in synchrony with the generation of the x-rays. In other words, the leaves 108*a*, 108*b*, 108*c*, 108*d* may modify the beams substantially in real time with the generation of the beams by the x-ray source 102. For example, the controller 112 may be programmed to send a logic pulse signal (e.g. high/low or equivalently go/no-go) simultaneously to both the x-ray generator 102 and the motorized system 110, which activates the x-ray source 102 to generate x-ray beams and trigger the motion mechanisms 110 to control the movement of the collimator leaves 108*a*, 108*b*, 108*c*, 108*d*. Therefore, the controller 112 may allow generation of x-rays of an energy spectrum and selection of a particular leaf for modifying a beam quality of the x-rays, or allow generation of x-rays of an energy spectrum and collective movement of the leaves to define an aperture for modifying the size, shape and/or beam quality of the x-rays. The controller 112 may also be programmed to allow a sequence in generating x-ray pulses of different energies and selection of different leaves corresponding to the sequence of x-ray pulses generated.

Embodiments of the collimator assembly and the apparatus including the collimator assembly can be advantageously used in multi-energy imaging. X-ray sources typically emit a continuous range of energies up to a maximum value. This maximum is dependent on the peak voltage (kVp in case of diagnostic beam) applied to the x-ray tube. Higher kVp beams are more penetrating but produce less contrast (dark to light difference) in images whereas it is the opposite for lower energy beams. Hence by combining (e.g. by using weighted logarithmic subtraction) images of the same object acquired with different energy spectra, visualization of features of interest can be greatly increased. The results improve as the mean energy separation between the spectra increases. This energy separation can be significantly improved by adding appropriate x-ray filters in the beam for each kVp used. For sequential imaging with multiple kVp, the filters would have to be changed from x-ray pulse to pulse depending on the application. Embodiments of the collimator described in this disclosure can advantageously synchronize the changing of filters with the x-ray generator so that the correct filter for each chosen kVp can be presented to the beam. Embodiments of the collimator described in this disclosure allow any possible combination of filters and kVp depending upon the application requirements.

In a specific application in lung imaging for example, two successive image frames can be acquired using beams of different energies. By weighting the images appropriately and subtracting one image from another, desired features made of a certain material can be highlighted or suppressed. By fast switching of filters in image acquisition and using image processing methods, bones can be virtually "removed" to allow better visualization of the underlying soft tissue. The fast synchronized switching allows minimal shift between two successive image frames particularly in cases where motion is present such as breathing motion in case of lung imaging. This may also allow rapid synchronized multi-energy imaging in non-destructive testing particularly of large objects where the object could be slowly translated through the field of view for full coverage.

Figure 5:
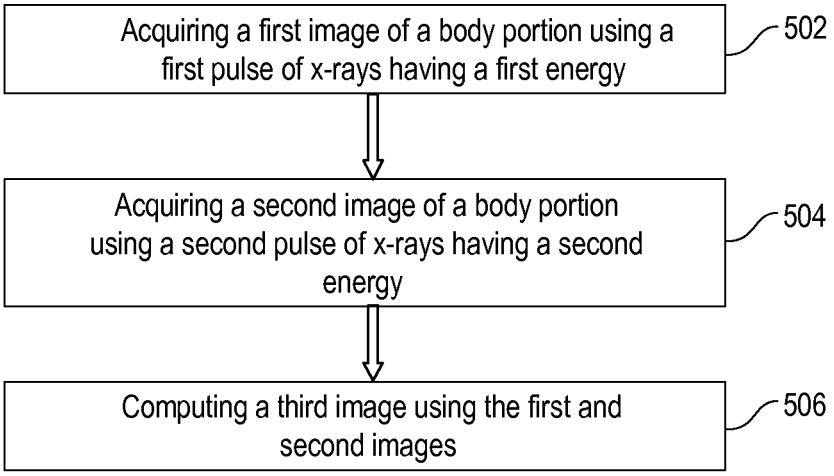
FIG. 5 is a flow chart illustrating an exemplary multi-energy imaging method according to some embodiments of this disclosure.

FIG. 5 is a flow chart illustrating exemplary steps of a multi-energy imaging method according to embodiments of this disclosure. In the method, a first image of a body portion may be acquired using a first pulse of x-rays having a first energy (502). A second image of the body portion may be acquired using a second pulse of x-rays having a second energy (504). The first and second images may be combined to provide a third image (506). The first and second pulses of x-rays may be generated by an x-ray source and modulated by a collimator assembly. The collimator assembly may comprise two or more leaves each may be independently moveable in synchrony with the operation of the x-ray source such that the beam quality of the first or second pulse of x-rays can be modulated by one of the two or more leaves substantially in real time with the generation of the first or second pulses. In some embodiments, the beam quality of each of the first and second pulses of x-rays may be modulated by one of the two or more leaves substantially in real time with the generation of the each of the first and second pulses.

Figure 6:
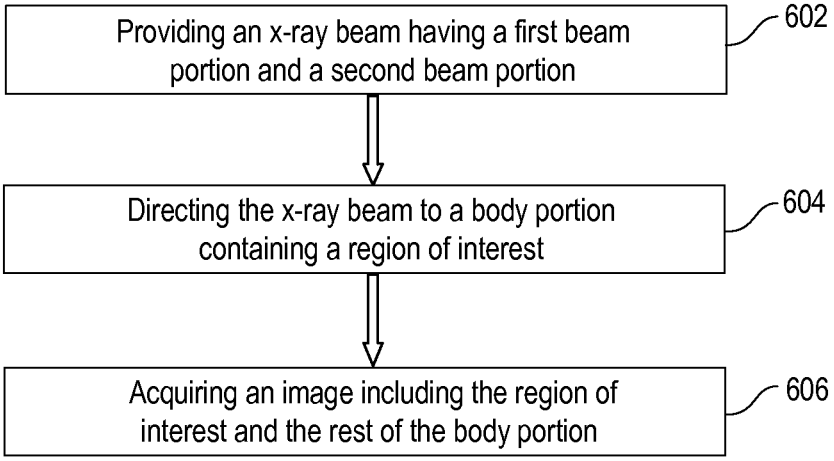
FIG. 6 is a flow chart illustrating an exemplary imaging method according to some embodiments of this disclosure.

Embodiments of the collimator assembly and the apparatus including the collimator assembly can be advantageously used to improve the imaging of the region of interest and reduce the exposure of x-rays to the patient in areas outside the region of interest. FIG. 6 is a flow chart illustrating exemplary steps of an imaging method according to some embodiments of this disclosure. In the imaging method, an x-ray beam having a first beam portion with a first beam quality and a second beam portion with a second beam quality different from the first beam quality is provided (602). The x-ray beam is directed to a body portion containing a region of interest, wherein the first beam portion with the first beam quality is directed to the region of interest and the second beam portion with the second beam quality is directed to the rest of the body portion (604). An image is acquired including both the region of interest and the rest of the body portion (606).

The x-ray beam having a first and a second beam portions can be provided by a collimator assembly comprising two or more leaves, wherein each of the two or more leaves may comprise a same material that partially attenuates x-rays or a material of same x-ray attenuating property. The two or more leaves can be independently moved by a motorized system to define an aperture, thereby allowing the first beam portion passing through the aperture to the region of interest and the second beam portion passing through the thickness of the two or more leaves to the rest of the body portion. The two or more leaves of the collimator assembly can be moved in synchrony with the operation of the x-ray source such that the aperture can be defined substantially in real time with generation of the x-rays.

In a specific embodiment, the x-ray beam having a first and a second beam portions can be provided by a collimator comprising four leaves. Each of the four leaves may comprise a same material that partially attenuates x-rays or a material of same x-ray attenuating property. The four leaves can be set up in a configuration that adjacent two leaves are linearly movably in directions perpendicularly to each other. The leaves can be independently moved to define an aperture, thereby allowing the first beam portion passing through the aperture to the region of interest and the second beam portion passing through the thicknesses of the leaves to the rest of the body portion. The four leaves of the collimator can be moved in synchrony with the operation the x-ray source such that the aperture can be defined substantially in real time with generation of the x-rays.

Exemplary embodiments of a collimator apparatus and an imaging method have been described. Those skilled in the art will appreciate that various modifications may be made within the spirit and scope of the disclosure. All these or other variations and modifications are contemplated by the inventors and within the scope of the disclosure.

The invention claimed is:

1. An apparatus, comprising:

an x-ray source operable to generate x-ray beams;

a collimator comprising one or more leaves configured to modify the x-ray beams, wherein each of at least one of the one or more leaves comprises at least a portion that is partially x-ray attenuating configured to modulate a beam quality of the x-ray beams passing therethrough to provide for imaging or treatment of a body portion, and each of the portion covers an entire field of view of the x-ray beams on the body portion being imaged or treated, and the portion has a substantially uniform thickness;

a motorized system operable to move the one or more leaves independently in or out of the x-ray beams; and a controller configured to synchronize an activation of the x-ray source with an activation of the motorized system, wherein the one or more leaves move in synchronization with the activation of the x-ray beams.

2. The apparatus of claim 1 wherein the x-ray source is operable to generate the x-ray beams in pulses and the motorized system is operable to move the one or more leaves in synchrony with operation of the x-ray source thereby allowing modification of the x-ray beams on a pulse to pulse basis.

3. The apparatus of claim 1 wherein each of the one or more leaves is movable to cover an entire field of view of the x-ray beams.

4. The apparatus of claim 3 wherein each of the one or more leaves is configured to modulate the beam quality of the x-ray beam.

5. The apparatus of claim 4 wherein each of the one or more leaves comprises a same material that partially attenuates x-rays.

6. The apparatus of claim 4 wherein each of the one or more leaves comprises a different material that partially attenuates x-rays.

7. The apparatus of claim 1, wherein the at least one of the one or more leaves is configured to modify energy of the x-ray beams passing therethrough to provide for imaging or treatment of a body portion.

8. A collimator assembly, comprising:

two or more leaves configured to modify an x-ray beam, wherein a substantially entire portion of each of the two or more leaves is partially x-ray attenuating configured to modulate a beam quality of the x-ray beam passing therethrough to provide for imaging or treatment of a body portion, the substantially entire portion of each of the two or more leaves has a substantially uniform thickness; and a motorized system operable to move the two or more leaves independently in or out of the x-ray beam;

wherein the two or more leaves are movable to define an aperture to allow a first beam portion passing through the aperture and a second beam portion passing through a thickness of each of the two or more leaves, wherein the two or more leaves are configured to move synchronously with an activation of the x-ray beam, thereby providing a modified beam for imaging or treatment of a body portion, the modified beam comprising the first beam portion having a first beam quality and the second beam portion having a second beam quality.

9. The collimator assembly of claim 8 wherein each of the two or more leaves is movable to cover an entire field of view of the x-ray beam.

10. The collimator assembly of claim 8 comprising four leaves, wherein adjacent two leaves are movably in directions perpendicularly to each other, and each of the four leaves is movable to cover an entire field of view of the x-ray beam.

11. The collimator assembly of claim 10 wherein each of the four leaves is configured to modulate the beam quality of the x-ray beam.

12. The collimator assembly of claim 11 wherein each of the four leaves comprises a same material that partially attenuates x-rays.

13. The collimator assembly of claim 12 wherein the four leaves are moveable to define the aperture to allow the first portion of the x-ray beam passing through the aperture and the second portion of the x-ray beam passing through thicknesses of the four leaves, thereby providing the modified beam comprising the first beam portion having the first beam quality and the second beam portion having the second beam quality.

14. The collimator assembly of claim 11 wherein each of the four leaves comprises a different material that partially attenuates x-rays.

15. The apparatus of claim 8, wherein the at least one of the one or more leaves is configured to modify energy of the x-ray beams passing therethrough to provide for imaging or treatment of a body portion.

16. An imaging method, comprising:

positioning a body portion containing a region of interest;

directing an x-ray beam to the body portion, wherein the x-ray beam has a first beam portion directed to the region of interest and a second beam portion directed to the rest of the body portion, wherein the first beam portion has a first beam quality and the second beam portion has a second beam quality different from the first beam quality; and acquiring an image including the region of interest and the rest of the body portion;

wherein the first and second beam portions are provided by a collimator assembly comprising two or more leaves, wherein a substantially entire portion of each of the two or more leaves partially attenuates x-rays and has a substantially uniform thickness, the two or more leaves are confiqured to move synchronously with an activation of the x-ray beam defining an aperture, thereby allowing the first beam portion passing through the aperture to the region of interest and the second beam portion passing through thicknesses of the two or more leaves to the rest of the body portion to provide for imaging or treatment.

17. The method of claim 16 wherein the x-ray beam is generated by an x-ray source, and wherein each of the two or more leaves of the collimator assembly is independently moveable in synchrony with operation of the x-ray source such that the aperture is defined substantially in real time with generation of the x-rays.

18. The imaging method of claim 16, wherein each of the two or more leaves is configured to modify energy of the x-ray beams passing through the thicknesses of the two or more leaves.

19. An imaging method, comprising:

positioning a body portion to be imaged;

acquiring a first image of the body portion using a first pulse of x-rays having a first energy;

acquiring a second image of the body portion using a second pulse of x-rays having a second energy;

computing a third image using the first and second images;

wherein the first and second pulses of x-rays are generated by an x-ray source and modulated by a collimator assembly, wherein the collimator assembly comprises two or more leaves each being independently moveable in synchrony with operation of the x-ray source such that a beam quality of at least one of the first and second pulses of x-rays is modulated by one of the two or more leaves moving in synchronization with an activation of the at least one of the first and second pulses by passing through a thickness of the one of the two or more leaves, wherein the one of the two or more leaves comprises at least a portion that covers an entire field of view of the at least one of the first and second pulses on the body portion being imaged and the portion has a substantially uniform thickness.

20. The method of claim 19 wherein a beam quality of each of the first and second pulses of x-rays is modulated by one of the two or more leaves substantially in real time with the activation of the each of the first and second pulses by passing through a thickness of the one of the two or more leaves, and each of the two or more leaves comprises at least a portion that covers an entire field of view of each of the first and second pulses on the body portion being imaged and the portion has a substantially uniform thickness.

21. The imaging method of claim 19, wherein each of the two or more leaves is configured to modify energy of at least one of the first and second pulses of x-rays.

22. An apparatus, comprising:

an x-ray source operable to generate x-ray beams;

a collimator comprising one or more leaves configured to modify the x-ray beams, wherein each of at least one of the one or more leaves comprises at least a portion that covers an entire field of view of the x-ray beams on a body portion being imaged or treated, wherein the portion is partially x-ray attenuating configured to substantially uniformly change energy of the x-ray beams penetrating through a thickness of the portion;

a motorized system operable to move the one or more leaves independently in or out of the x-ray beams; and a controller configured to synchronize an activation of the x-ray source with an activation of the motorized system wherein the one or more leaves move in synchronization with the activation of the x-ray beams.

23. The apparatus of claim 22, wherein the portion of the at least one of the one or more leaves substantially uniformly stops x-ray photons having a given energy level or range.

24. The apparatus of claim 22, wherein the portion of the at least one of the one or more leaves substantially uniformly stops x-ray photons having energies at or below a given level.

* * * * *